United States Patent [19]

Niedermeyer

[11] 3,972,647

[45] Aug. 3, 1976

[54] SCREEN FOR INTAKE OF EMERGENCY SUMP PUMP

[76] Inventor: Karl O. Niedermeyer, 17W068 North St., Bensenville, Ill. 60106

[22] Filed: Sept. 9, 1974

[21] Appl. No.: 504,426

Related U.S. Application Data

[63] Continuation-in-part of Ser. No. 460,423, April 12, 1974, Pat. No. 3,941,507.

[52] U.S. Cl. ..... 417/2; 417/40; 415/121 G

[51] Int. Cl.² ..... F04B 41/06; F04B 49/04

[58] Field of Search ..... 417/36, 37, 38, 40, 417/2; 415/121 G

[56] References Cited

UNITED STATES PATENTS

| | | | |
|---|---|---|---|
| 1,854,517 | 4/1932 | Layne | 415/121 G |
| 3,164,095 | 1/1965 | Williams | 417/40 |
| 3,319,571 | 5/1967 | Schaefer | 417/40 |
| 3,794,789 | 2/1974 | Bynum | 417/38 |
| 3,814,544 | 6/1974 | Roberts et al. | 417/40 |

*Primary Examiner*—William L. Freeh
*Assistant Examiner*—G. P. LaPointe
*Attorney, Agent, or Firm*—Darbo, Robertson & Vandenburgh

[57] ABSTRACT

An emergency sump pump is employed in a sump from which the liquid is normally removed by a main pump. The main pump turns on when the liquid rises to an upper level and turns off when the liquid drops to a lower level. The emergency pump has a vertical intake conduit which opens at the bottom below the lower level. This conduit is surrounded by a tube which has openings in areas below the lower level and above the upper level. The tube is solid between those two levels and also is solid above the upper area of openings.

8 Claims, 1 Drawing Figure

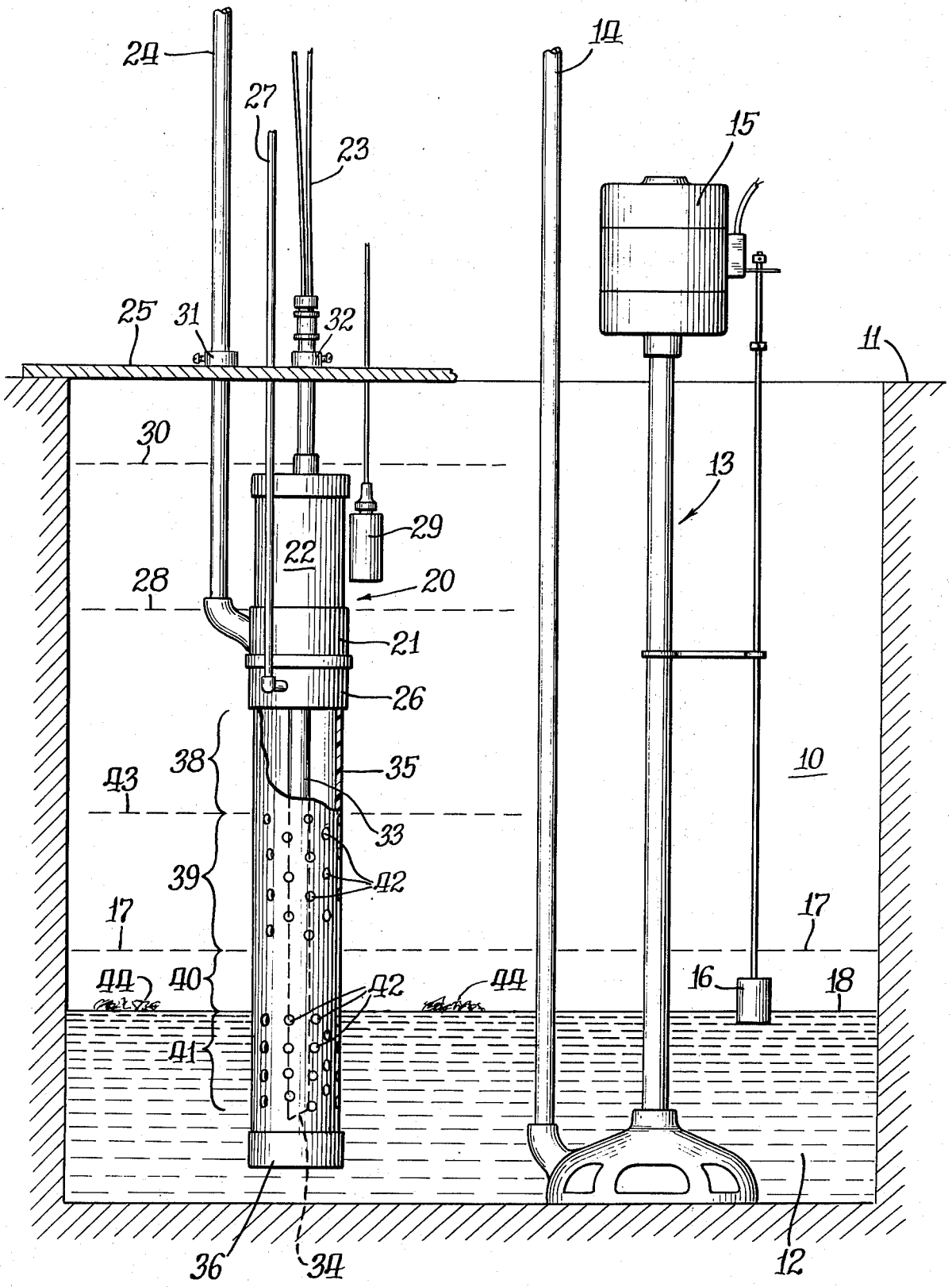
24
14
27
23
15
25
31
32
11
30
13
29
22
28
20
21
26
38
35
10
43
33
39
42
17
17
44
40
42
44
16
18
41
36
34
12

SCREEN FOR INTAKE OF EMERGENCY SUMP PUMP

RELATED APPLICATION

This application is a continuation-in-part of my pending application S.N. 460,423, filed Apr. 12, 1974, now U.S. Pat. No. 3,941,507.

BACKGROUND AND SUMMARY OF THE INVENTION

For many years sump pumps have been employed in low locations, e.g. basements of homes and business buildings, to protect against undesired accumulations of water such as may occur as a result of heavy rains, sewer blockages, etc. It is not uncommon for these sump pumps to fail either by reason of electrical power failure, such as often occurs as a result of a bad storm, or by reason of a functional failure in the pump or its motor. To guard against such malfunctions supplemental, battery operated, pumps are employed in the sump to take over when the primary pump fails. One such apparatus is described in my prior U.S. Pat. No. 3,634,842. It is extremely important that the supplemental pump operate properly when it is called upon to do so.

It is not uncommon for there to be floating debris in the sump. Such debris may include solid debris such as paper, sticks, leaves and the like. Also, it will often include various scum forming materials such as oil, grease, soap, detergent, chemicals, etc. While these scum forming materials will generally pass through the pump, while it is operating, without causing any obstruction, over a period of time the scums that they form can dry and build up on components impairing operation. Of course, the paper, sticks, etc., are likely to impair the action of the pump should they enter the pump while it is operating and therefore it is important to prevent them from reaching the intake opening of the pump. This obviously can be done by screening and a screen with relatively large openings can be employed which will not impair the flow of liquid to the intake opening of the pump. However, the scum forming materials will pass through such a screen, particularly if it has relatively large openings, with the scum then building up on the inside of the screen and the components within the screen. When this occurs, there is a danger of impairment of the operation of the pump. It is not possible to screen out the scum forming materials, at least without seriously restricting the flow of liquid to the pump and, perhaps, not then. This can be a particularly serious problem with a secondary or back-up pump which operates only very infrequently; yet, the necessity for such a pump to operate when required is all the more important.

The principal object of the present invention is to provide an apparatus for protecting the intake of such an emergency sump pump by screening out the solid floating debris and at the same time restricting the entry of the floating scum forming materials to the interior of the screen. Through the use of the present invention, the screen openings can be relatively large, being dictated solely by the size of the solid floating debris.

In a further feature of the invention, the floating scum forming materials are denied entry to the interior of the screen, both during the normal operation of the primary sump pump and also during the normal operation of the emergency sump pump. At all times, however, the liquid to be pumped can flow to the interior of the screen and the solid debris is filtered out.

Further objects and advantages will become apparent from the following description.

DESCRIPTION OF THE DRAWING

The drawing is a sectional view of a sump in which is a primary sump pump and an emergency sump pump incorporating the present invention.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The drawing illustrates a sump 10 which, for example, may extend downwardly from a floor 11. It is employed to accumulate water 12 so that the floor 11 will remain relatively dry. The water is pumped to a remote location (e.g. a storm sewer) through a pipe 14 by a primary sump pump, generally 13. The pump includes a motor 15 which is switched on and off by a float 16. The arrangement is such that the pump 13 is switched on when the water rises to the level indicated by dashed line 17 and is switched off when the pump has operated sufficiently to lower the water level to that shown at 18. Various forms of such sump pumps are well known in the art and the foregoing is merely exemplary of the known equipment.

To guard against a malfunction of the primary sump pump 13 an emergency sump pump, generally 20, is employed. This pump includes a pump body 21 within which is an impeller (not shown) driven by a battery operated motor 22. The motor is of a submersible type and is supplied with electrical power through wires 23. The liquid pumped is discharged through a pipe 24 leading, for example, to a storm sewer. The pump 20 is suitably supported in the sump as by means of a floor plate 25 covering the sump. Collars 31 and 32 are placed about discharge pipe 24 and the electrical conduit holding wires 23. These collars are held in place on the pipe and conduit by set screws and rest on plate 25. In some installations a collar only on a pipe or conduit will be sufficient. Also, pipe fittings may be substituted for collars; however, the collars permit subsequent vertical adjustment which would not be as readily available where pipe fittings were used for support.

Controls for operating such an emergency sump pump are described in detail in my pending application S.N. 460,423, now U.S. Pat. No. 3,941,507, the disclosure of which is incorporated herein by reference. As described in that application, the bottom of the body of the pump forms a bell 26, which bell is open at the bottom. A tube 27 communicates with this bell and leads to a pressure actuated switch in the control unit. When the water level rises to about the level indicated by the dashed line 28 the air trapped in bell 26 has developed sufficient pressure to actuate the switch and energize the motor 22. As the water level drops so that the air pressure in the bell 26 is substantially equal to ambient, that switch again turns the motor off. As a further precaution against a malfunction in that switch, etc., the controls also include a float switch 29 which will actuate a backup energizing circuit for motor 22 when the water level rises to approximately that indicated by dashed line 30.

The intake for pump 21 is formed by a conduit 33 which extends down through the bell and has an intake opening 34 at the bottom thereof. A plastic tube 35 is secured to the bell 26 of pump body 21. The interior of the tube at its upper end communicates with the interior of bell 26 and the juncture of the tube and bell is fluid tight. The bottom end of the tube is below intake opening 34 and is closed by a plastic cap 36. The cap is frictionally fitted to the tube so that it may be removed. In some embodiments the cap will be fixed in place, as by means of an adhesive, but I prefer that it be removable.

The tube is vertically divided into four portions 38–41. The upper portion 38 is solid so as to prevent the passage of fluid through the tube wall at that portion. The next lower portion 39 has a plurality of openings 42 therein whereby fluid can pass from one side of the wall to the other. The next lower portion 40 again is solid to block the passage of fluid through that portion of the wall. The lowermost portion 41 again has a plurality of openings 42. The arrangement of the portions is such that during the normal operation of either the primary sump pump 13 or the emergency sump pump 20 the surface level of the water will not be in the areas in which the openings 42 exist, i.e. will not be at portions 39 and 41 of the tube. To be more specific, the portion 40 of the tube extends between the upper water level 17 and the lower water level 18 that occur during the normal operation of the sump pump 13. The portion 39 of the tube is below the water levels that exist during the normal operation of the emergency pump 20 and above the water levels that exist during the normal operation of pump 13. As previously explained, the pump 20 turns on when the water rises to the dashed line 28 and turns off when the air pressure within bell 26 approaches ambient pressure which will occur immediately before, or at about the time that the water level drops to dashed line 43. The portion 38 of the tube thus is in the range of water levels occurring during the normal operation of sump pump 20.

Thus, during the period of operation of the respective pumps, the floating debris, including the scum forming material that may be floating on the water, is denied access to the interior of tube 35. However, in either event the water is free to flow into the interior of the tube through openings 42 which are below the water surface and thus have free access to intake opening 34 of the pump. Since the only purpose of the screens formed by portions 39 and 41 is to prohibit entry of solid floating materials, the openings 42 can be relatively large. Thus the openings can be as large as three-eighths to five-eighths of an inch in diameter.

Battery operated pumps, such as the one designated 20 in the drawing, can be employed as the primary sump pump. They are particularly useful, for example, on a small boat where the only electrical supply is batteries which provide relatively low voltage electrical current. When so used, the normal water level of the pump during its operation is established above that portion of the tube having the openings 42 therein. For example, using the pump 20, the normal operational level of the water is between dashed lines 28 and 43. The portion 39 of the tube is below that. Thus, there is no opportunity for any floating scum forming material to enter the interior of the tube 35.

It is important to achieving the object of having a pump that will operate reliably that the pump unit 20 be high enough to be above the normal water levels in the sump (e.g. above line 17). This is achieved by using a draw pipe 33 which extends from the pump unit down to a level adjacent the bottom of the sump. Additionally, this permits the sump to be substantially emptied as desired. The control system described in my application S.N. 460,423 includes a manually operable switch for energizing motor 22. By so energizing the motor, the pump 20 can be operated until the liquid level in the sump has dropped to the bottom of the draw pipe 33 and, by positioning the bottom of the draw pipe adjacent the bottom of the sump, the sump will thus be substantially emptied of liquid. Furthermore, the use of a draw pipe 33, permits liquid to be drained from areas having relatively small physical dimensions, i.e. dimensions sufficiently small as to prevent the insertion of the pump itself. Such conditions are encountered, for example, in a boat bilge where the sides of the boat are relatively close together.

The length of the draw pipe and that of the tube 35 can be cut on the job to accommodate the conditions that are encountered. A tube as manufactured may have openings 42 therein over relatively limited vertical dimensions. Adding another row or two of openings 42 may be performed on the job as necessary. Further adjustment to accommodate a unit to the particular job is provided by the use of collars 31, 32.

I claim:

1. In a pump apparatus including a pump having a body, and power means for driving the pump, said pump having an intake opening and used to remove liquid from a sump, bilge, or the like wherein liquid accumulates with the liquid normally being between predetermined limits of height, and a screen device enclosing said intake opening for restricting access of floating debris to said opening, the improvement comprising:

said screen device comprising a tube having upper and lower ends, the upper end being affixed to said body with the tube extending downwardly therefrom, said tube having four portions in vertical arrangement, the uppermost of the portions being solid, the next lower portion having openings therein, the then next lower portion being solid, and the lowermost of the four portions having openings therein, said pump having an intake conduit extending from said body through said tube, said conduit defining said intake opening adjacent the lower end of the tube, said body forming a closure for the upper end of the tube.

2. In a pump apparatus as set forth in claim 1, including removable cover means for the lower end of the tube.

3. In a pump apparatus including an emergency pump having a body, power means for driving said emergency pump and means for mounting said emergency pump, said pump having an intake opening and being used to remove liquid from a sump, bilge, or the like wherein liquid accumulates with the liquid normally being between predetermined limits of height, and a screen device enclosing said intake opening for restricting access of floating debris to said opening, and employed as an emergency apparatus to back up a primary sump pump which normally operates to maintain the liquid between said limits of height, the improvement wherein said device comprises a tube having upper and lower ends, and two portions between said ends, the uppermost of the two portions being solid and extending throughout said vertical height, the lowermost of said two portions having openings therein, said tube having a third portion above said uppermost of said two portions, the third portion having openings therein, said emergency pump having an intake conduit extending from said body down through said tube, said conduit defining said intake opening adjacent the lower end of the tube.

4. In a pump apparatus as set forth in claim 3, wherein said tube has a fourth portion above said third portion, the fourth portion being solid, wherein said body forms a closure for the upper end of the tube, and including cover means for the lower end of the tube.

5. In a pump apparatus as set forth in claim 4, wherein said cover means for the lower end of the tube is removable.

6. In a pump apparatus as set forth in claim 4, wherein said tube and cover means are formed of plastic.

7. In a pump apparatus as set forth in claim 3, wherein said tube and conduit extend approximately to the bottom of said sump, and said pump and power means are positioned above said limits of height.

8. In a pump apparatus as set forth in claim 3 including means secured to the unit for supporting said unit in said sump, said means permitting adjustment of the height of the unit in the sump.

* * * * *

UNITED STATES PATENT AND TRADEMARK OFFICE

CERTIFICATE OF CORRECTION

PATENT NO. : 3,972,647

DATED : August 3, 1976

INVENTOR(S) : Karl O. Niedermeyer

It is certified that error appears in the above-identified patent and that said Letters Patent are hereby corrected as shown below:

Column 2, line 47, "a", second occurrence, should read --the--.

Column 4, line 50, after "body" should be inserted --down--.

Signed and Sealed this

Seventh Day of December 1976

[SEAL]

*Attest:*

RUTH C. MASON
*Attesting Officer*

C. MARSHALL DANN
*Commissioner of Patents and Trademarks*